US009957133B2

(12) United States Patent
Shiraishi et al.

(10) Patent No.: US 9,957,133 B2
(45) Date of Patent: May 1, 2018

(54) ELEVATOR APPARATUS

(71) Applicants: Naohiro Shiraishi, Chiyoda-ku (JP); Seiji Watanabe, Chiyoda-ku (JP); Kotaro Fukui, Chiyoda-ku (JP)

(72) Inventors: Naohiro Shiraishi, Chiyoda-ku (JP); Seiji Watanabe, Chiyoda-ku (JP); Kotaro Fukui, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 153 days.

(21) Appl. No.: 14/761,221

(22) PCT Filed: Feb. 7, 2013

(86) PCT No.: PCT/JP2013/052901
§ 371 (c)(1),
(2) Date: Jul. 15, 2015

(87) PCT Pub. No.: WO2014/122754
PCT Pub. Date: Aug. 14, 2014

(65) Prior Publication Data

US 2015/0353323 A1 Dec. 10, 2015

(51) Int. Cl.
*B66B 5/12* (2006.01)
*B66B 5/04* (2006.01)
*B66B 7/10* (2006.01)

(52) U.S. Cl.
CPC ..... *B66B 5/12* (2013.01); *B66B 5/04* (2013.01); *B66B 7/10* (2013.01)

(58) Field of Classification Search
CPC .. B66B 5/04; B66B 5/044; B66B 5/12; B66B 7/068; B66B 7/10
See application file for complete search history.

(56) References Cited

U.S. PATENT DOCUMENTS 1,944,772 A * 1/1934 White ..... B66B 7/068 187/265
4,522,285 A * 6/1985 Salmon ..... B66B 7/068 104/196

(Continued)

FOREIGN PATENT DOCUMENTS

CN 101100259 A 1/2008
EP 2 487 128 8/2012

(Continued)

OTHER PUBLICATIONS

Combined Chinese Office Action and Search Report dated Jun. 20, 2016 in Patent Application No. 201380071721.5 (with partial English language translation and English translation of categories of cited documents).

(Continued)

*Primary Examiner* — Minh Truong
(74) *Attorney, Agent, or Firm* — Oblon, McClelland, Maier & Neustadt, L.L.P.

(57) ABSTRACT

In an elevator apparatus, a safety device is activated using a force that is generated by a mass body that includes sheaves and a rope, if acceleration of a car reaches an abnormal acceleration set value. A tensioning sheave that can be moved vertically in order to apply tension to the rope is included among the sheaves. A vertical vibration suppressing apparatus that is connected to the tensioning sheave allows vertical displacement of the tensioning sheave during normal operation while also suppressing vertical vibration of the tensioning sheave if the acceleration of the car reaches the abnormal acceleration set value.

1 Claim, 9 Drawing Sheets

(56) References Cited

U.S. PATENT DOCUMENTS

| | | | | |
|---|---|---|---|---|
| 4,565,264 | A * | 1/1986 | Kunii | B66B 5/06 187/373 |
| 4,928,796 | A * | 5/1990 | Poon | B66B 5/18 187/288 |
| 5,277,276 | A * | 1/1994 | Pramanik | B66B 7/068 187/411 |
| 5,641,041 | A * | 6/1997 | Masuda | B66F 9/07 187/347 |
| 6,216,824 | B1 * | 4/2001 | Fuller | B66B 7/08 187/292 |
| 7,798,290 | B2 * | 9/2010 | Mustalahti | B66B 7/10 187/264 |
| 7,905,328 | B2 * | 3/2011 | Windlin | B66B 5/06 187/286 |
| 8,047,335 | B2 * | 11/2011 | Fargo | B66B 7/085 187/411 |
| 8,739,937 | B2 * | 6/2014 | Fischer | B66B 7/08 187/393 |
| 9,038,782 | B2 * | 5/2015 | Blanchard | B66B 7/08 187/411 |
| 2012/0175194 | A1 * | 7/2012 | Nikawa | B66B 5/22 187/376 |
| 2013/0220739 | A1 | 8/2013 | Okada et al. | |

FOREIGN PATENT DOCUMENTS

| | | |
|---|---|---|
| JP | 47 42763 | 10/1972 |
| JP | 50 112951 | 9/1975 |
| JP | 7 2451 | 1/1995 |
| JP | 7 228447 | 8/1995 |
| JP | 11 21044 | 1/1999 |
| JP | 11 71069 | 3/1999 |
| JP | 2008 13309 | 1/2008 |
| JP | 2008-230779 A | 10/2008 |
| WO | 2011 042972 | 4/2011 |
| WO | 2012 059970 | 5/2012 |

OTHER PUBLICATIONS

International Search Report dated Mar. 5, 2013 in PCT/JP2013/052901 Filed Feb. 7, 2013.

* cited by examiner

ELEVATOR APPARATUS

TECHNICAL FIELD

The present invention relates to an elevator apparatus in which a car is made to perform an emergency stop using a safety device if a suspending body breaks, for example.

BACKGROUND ART

In conventional elevator apparatuses, a safety device is activated by an abnormal acceleration detecting mechanism if acceleration that exceeds a preset value arises in a car. The abnormal acceleration detecting mechanism has a mass body that operates in connection with movement of the car, and operates the safety device using a force that is generated by the mass body if an acceleration rate that exceeds a set value arises in the car. A speed governor rope to which an activating lever of the safety device is connected and a speed governor sheave and a tensioning sheave onto which the speed governor rope is wound are used as the mass body (see Patent Literature 1, for example).

CITATION LIST

Patent Literature

[Patent Literature 1]
WO 2012/059970 A1

SUMMARY OF THE INVENTION

Problem to be Solved by the Invention

In conventional elevator apparatuses such as that described above, if the hoisting zone of the car is long, making the speed governor rope long, longitudinal vibration of the speed governor rope may affect the operating speed of the safety device. Specifically, if the safety device is activated by the abnormal acceleration detecting mechanism when the suspending body breaks, the tensioning sheave may be displaced downward by vibration. This downward displacement suppresses rotational vibration of the speed governor rope, giving rise to a delay in the lifting time of the activating lever.

The present invention aims to solve the above problems and an object of the present invention is to provide an elevator apparatus in which a safety device can be activated in a shorter amount of time when abnormal acceleration is detected.

Means for Solving the Problem

In order to achieve the above object, according to one aspect of the present invention, there is provided an elevator apparatus including: a car that is raised and lowered inside a hoistway; a safety device that is mounted to the car; a plurality of sheaves that are disposed in an upper portion and a lower portion of the hoistway; and a rope that is wound onto the sheaves, that is connected to the safety device, and that is moved cyclically together with the raising and lowering of the car, a tensioning sheave that can be moved vertically in order to apply tension to the rope being included among the sheaves, and the safety device being activated if acceleration of the car reaches a preset abnormal acceleration set value, using a force that is generated by a mass body that includes the sheaves and the rope, wherein: a vertical vibration suppressing apparatus is connected to the tensioning sheave; and the vertical vibration suppressing apparatus allows vertical displacement of the tensioning sheave during normal operation while also suppressing vertical vibration of the tensioning sheave if the acceleration of the car reaches the abnormal acceleration set value.

Effects of the Invention

In the elevator apparatus according to the present invention, because vertical vibration of the tensioning sheave is suppressed by the vertical vibration suppressing apparatus if acceleration of the car acceleration reaches the abnormal acceleration set value, rotational vibration of the rope is prevented from being suppressed, enabling the safety device to be activated in a shorter amount of time.

DESCRIPTION OF EMBODIMENTS

Preferred embodiments of the present invention will now be explained with reference to the drawings.

Embodiment 1

Figure 1:
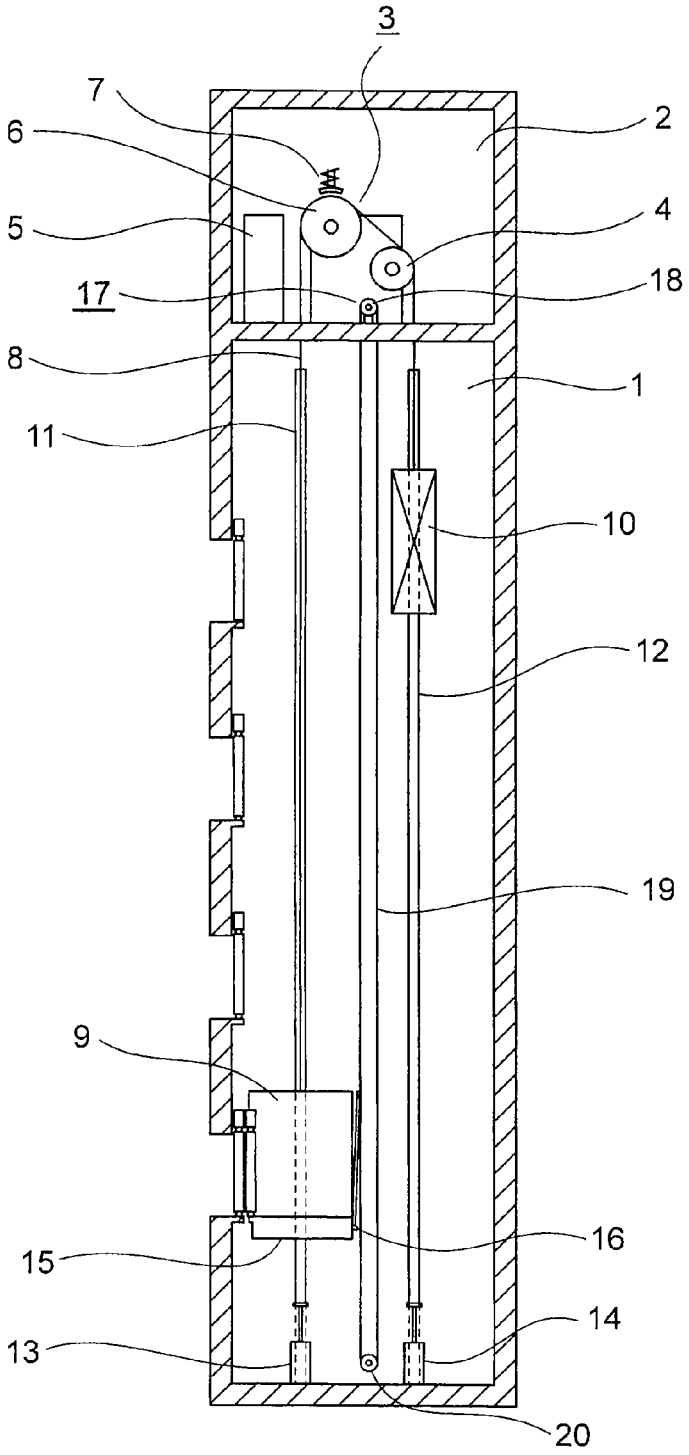
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. Installed in the machine room 2 are: a hoisting machine (a driving apparatus) 3; a deflecting sheave 4; and a controlling apparatus 5. The hoisting machine 3 has: a driving sheave 6; a hoisting machine motor that rotates the driving sheave 6; and a hoisting machine brake (an electromagnetic brake) 7 that brakes rotation of the driving sheave 6.

The hoisting machine brake 7 has: a brake wheel (a drum or a disk) that is coupled coaxially to the driving sheave 6; a brake shoe that is placed in contact with and separated from the brake wheel; a brake spring that presses the brake shoe against the brake wheel to apply a braking force; and an electromagnet that separates the brake shoe from the brake wheel in opposition to the brake spring to release the braking force.

A suspending body 8 is wound around the driving sheave 6 and the deflecting sheave 4. A plurality of ropes or a plurality of belts are used as the suspending body 8. A car 9 is connected to a first end portion of the suspending body 8. A counterweight 10 is connected to a second end portion of the suspending body 8.

The car 9 and the counterweight 10 are suspended inside the hoistway 1 by the suspending body 8, and are raised and lowered inside the hoistway 1 by the hoisting machine 3. The controlling apparatus 5 raises and lowers the car 9 at a set velocity by controlling rotation of the hoisting machine 3.

A pair of car guide rails 11 that guide raising and lowering of the car 9 and a pair of counterweight guide rails 12 that guide raising and lowering of the counterweight 10 are installed inside the hoistway 1. A car buffer 13 that buffers collision of the car 9 into a bottom portion of the hoistway 1, and a counterweight buffer 14 that buffers collision of the counterweight 10 into the bottom portion of the hoistway 1 are installed on the bottom portion of the hoistway 1.

A safety device 15 that makes the car 9 perform an emergency stop by engaging with a car guide rail 11 is mounted onto a lower portion of the car 9. A gradual safety device is used as the safety device 15 (gradual safety devices are generally used in elevator apparatuses in which rated velocity exceeds 45 m/min). An activating lever 16 that activates the safety device 15 is disposed on the safety device 15.

A speed governor 17 that detects overspeed velocity traveling of the car 9 is disposed in the machine room 2. The speed governor 17 has: a speed governor sheave 18 that functions as a sheave; an overspeed velocity detecting switch; a rope catch, etc. A speed governor rope 19 is wound around the speed governor sheave 18.

The speed governor rope 19 is installed in a loop inside the hoistway 1, and is connected to the activating lever 16. The speed governor rope 19 is wound around a tensioning sheave 20 that functions as a sheave that is disposed in a lower portion of the hoistway 1. The tensioning sheave 20 is movable vertically in order to apply tension to the speed governor rope 19. The speed governor rope 19 is moved cyclically when the car 9 is raised and lowered to rotate the speed governor sheave 18 at a rotational velocity that corresponds to the traveling velocity of the car 9.

The traveling velocity of the car 9 reaching the overspeed velocity is detected mechanically by the speed governor 17. A first overspeed velocity Vos that is higher than a rated velocity Vr and a second overspeed velocity Vtr that is higher than the first overspeed velocity are set as detected overvelocities.

The overspeed velocity detecting switch is operated if the traveling velocity of the car 9 reaches the first overspeed velocity Vos. When the overspeed velocity detecting switch is operated, power supply to the hoisting machine 3 is interrupted to stop the car 9 urgently using the hoisting machine brake 7.

If the descent velocity of the car 9 reaches the second overspeed velocity Vtr, the speed governor rope 19 is gripped by the rope catch to stop the cycling of the speed governor rope 19. When the cycling of the speed governor rope 19 is stopped, the activating lever 16 is operated, and the car 9 is made to perform an emergency stop by the safety device 15.

Figure 2:
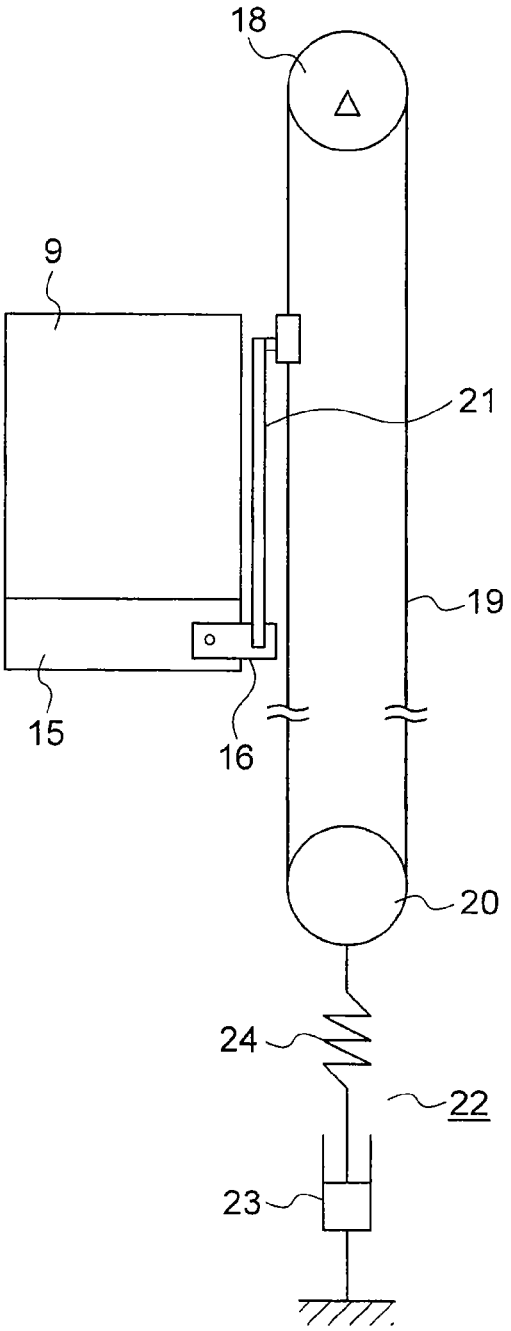
FIG. 2 is a configuration diagram that schematically shows part of the elevator apparatus in FIG. 1.

FIG. 2 is a configuration diagram that schematically shows part of the elevator apparatus in FIG. 1. The activating lever 16 is connected to the speed governor rope 19 by means of a lifting rod 21. A mass body according to Embodiment 1 includes the activating lever 16, the speed governor sheave 18, the speed governor rope 19, the tensioning sheave 20, and the lifting rod 21. If acceleration of the car 9 reaches a preset abnormal acceleration set value, then the activating lever 16 is actuated using a force that is generated by the mass body, activating the safety device 15.

The above-mentioned abnormal acceleration set value is set such that the velocity of the car 9 when the safety device 15 is activated due to the detection of abnormal acceleration is lower than the second overspeed velocity Vtr. The abnormal acceleration set value is set to a value that is higher than acceleration during normal operation so as to enable rapid acceleration of the car 9 due to abnormality of the controlling apparatus 5, etc., to be detected. The abnormal acceleration set value is also set to a value that is higher than the deceleration rate during urgent stopping by the hoisting machine brake 7 such that the safety device 15 is not activated when urgent stopping (also known as "E-Stopping") is performed during ascent of the car 9 due to a power outage, etc.

A torque (a resistance force) in an opposite direction to the direction that activates the safety device 15 is applied to the activating lever 16 and the lifting rod 21 in such a way that the safety device 15 is not activated during normal hoisting of the car 9 or during an emergency stop by the hoisting machine brake 7.

A vertical vibration suppressing apparatus 22 is connected to the tensioning sheave 20. The vertical vibration suppressing apparatus 22 allows vertical displacement of the tensioning sheave 20 during normal operation while also suppressing vertical vibration of the tensioning sheave 20 if the acceleration of the car 9 reaches the abnormal acceleration set value. Specifically, the vertical vibration suppressing apparatus 22 allows vertical displacement of the tensioning sheave 20 at a vibrational frequency that is lower than the primary natural frequency of the mass body, and suppresses vertical vibration of the tensioning sheave 20 at vibrational frequencies that are greater than or equal to the primary natural frequency.

The vertical vibration suppressing apparatus 22 has a damper 23 and a spring 24 that are connected in series between a lower portion of the hoistway 1 and the tensioning sheave 20.

Figure 3:
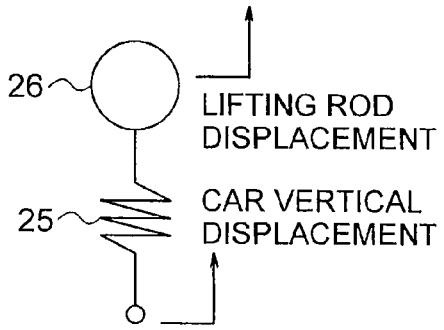
FIG. 3 is an explanatory diagram that shows a simple model of a governor mechanism from FIG. 2 that has one degree of freedom.

Action of the vertical vibration suppressing apparatus 22 will now be explained. FIG. 3 is an explanatory diagram that shows a simple model of a governor mechanism from FIG. 2 that has one degree of freedom. As described above, a force in an opposite direction to the direction that actuates the safety device 15, such as a downward pressing force from a resisting spring 25, for example, is applied to the activating lever 16 and the lifting rod 21.

The governor mechanism, which includes the mass body and the resisting spring 25, can be evaluated simply as a construction in which a total mass 26 that is the combined sum of the total mass of the speed governor rope 19, the activating lever 16, and the lifting rod 21 and the rotational inertial mass of the speed governor sheave 18 and the tensioning sheave 20 is supported by the resisting spring 25. Because of that, the operation of the safety device 15 by the inertial operation of the mass body can be said to be a phenomenon in which the lifting rod 21 vibrates at a natural frequency that is determined by the total mass 26 and the resisting spring 25.

Figure 4:
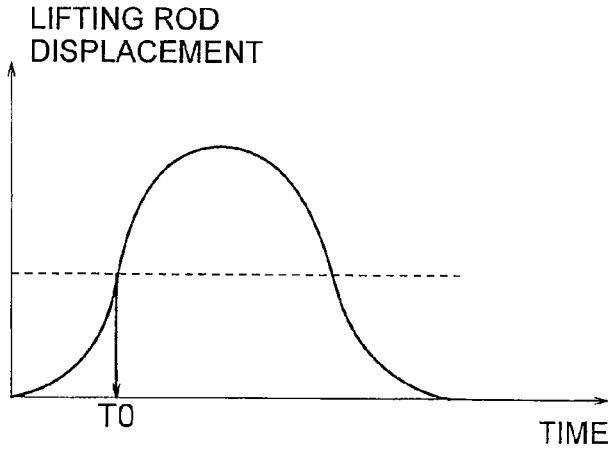
FIG. 4 is a graph that shows time response of displacement of a lifting rod from FIG. 2.

FIG. 4 is a graph that shows time response of displacement of a lifting rod from FIG. 2, the position at which the safety device 15 contacts the car guide rail 11 being represented by a broken line. The vibrational waveform of the lifting rod 21 is a vibrational waveform of simple harmonic motion, and the safety device 15 is activated, and deceleration of the car 9 begins, at a stage when the lifting rod 21 is pulled up to a position at which the safety device 15 contacts the car guide rail 11.

Because the velocity of the car 9 increases as the time (TO) until the safety device 15 operates is lengthened, it is desirable for the safety device 15 to be activated within approximately 200 msec of detection of the abnormal acceleration set value.

If the hoisting zone of the car 9 is long, however, then the length of the speed governor rope 19 is longer, and the model in which the total mass 26 from FIG. 3 moves as one body no longer holds. Consequently, if the hoisting zone is long, it is necessary to consider a vibrational model that has three degrees of freedom, as shown in FIG. 5.

Figure 5:
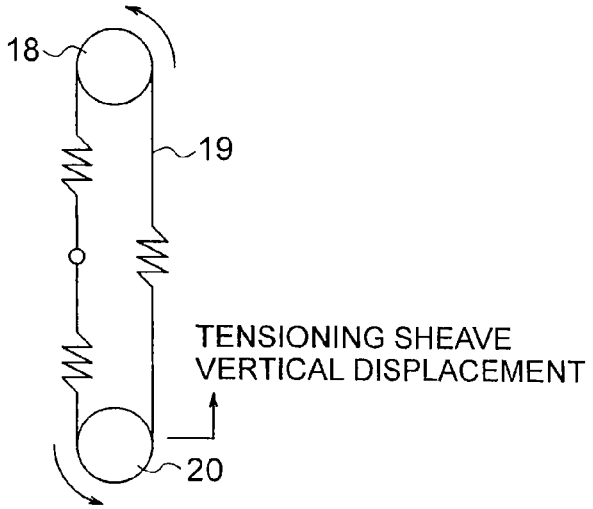
FIG. 5 is an explanatory diagram that shows a simple model of a governor mechanism from FIG. 2 that has three degrees of freedom.
Figure 6:
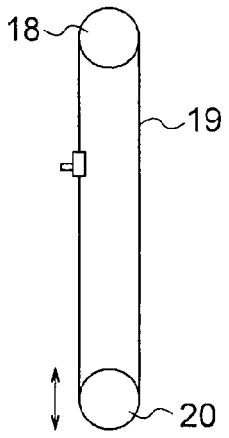
FIG. 6 is an explanatory diagram that shows a first mode of vibration in the simple model in FIG. 5.
Figure 7:
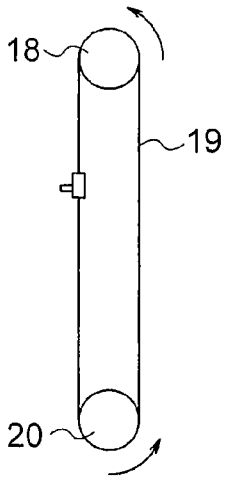
FIG. 7 is an explanatory diagram that shows a second mode of vibration in the simple model in FIG. 5.
Figure 8:
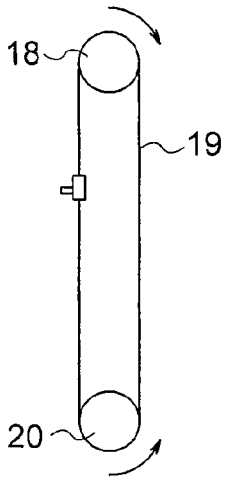
FIG. 8 is an explanatory diagram that shows a third mode of vibration in the simple model in FIG. 5.
Figure 9:
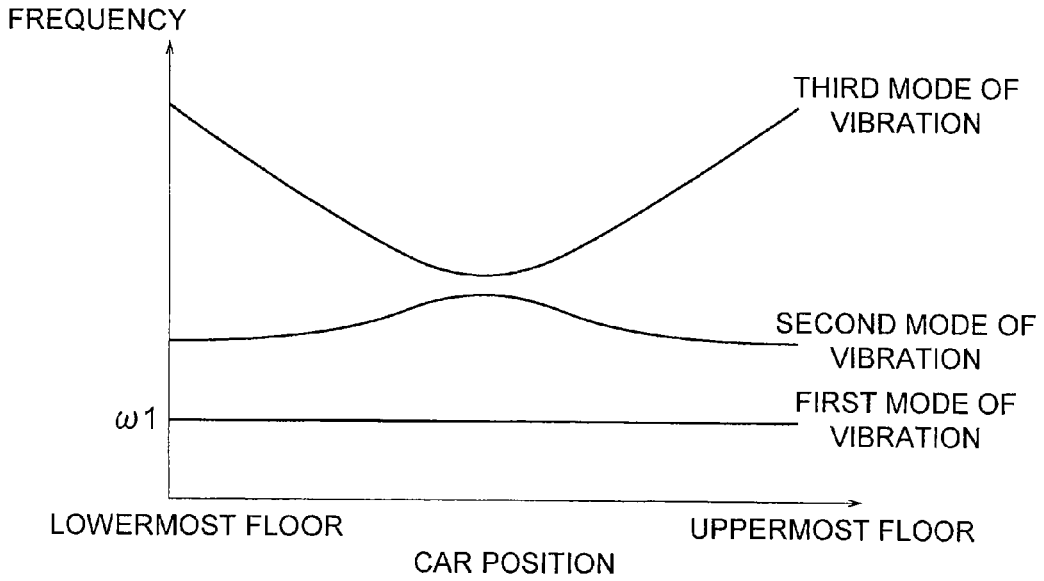
FIG. 9 is a graph that shows changes in frequency in the modes of vibration in FIGS. 6 through 8 according to car position.

FIG. 6 is an explanatory diagram that shows a first mode of vibration (vertical vibration of the tensioning sheave 20) in the simple model in FIG. 5, FIG. 7 is an explanatory diagram that shows a second mode of vibration (same-phase vibration of the speed governor sheave 18 and the tensioning sheave 20) in the simple model in FIG. 5, FIG. 8 is an explanatory diagram that shows a third mode of vibration (opposite-phase vibration of the speed governor sheave 18 and the tensioning sheave 20) in the simple model in FIG. 5, and FIG. 9 is a graph that shows changes in frequency in the modes of vibration in FIGS. 6 through 8 according to car position.

Movement of the lifting rod 21 when the hoisting zone is short is a simple harmonic motion response (natural frequency ω), as shown in FIG. 4. When the hoisting zone is long, on the other hand, (the natural frequency ω1) of the first mode of vibration approaches the natural frequency ω because the natural frequency that is shown in FIG. 9 is reduced.

Figure 10:
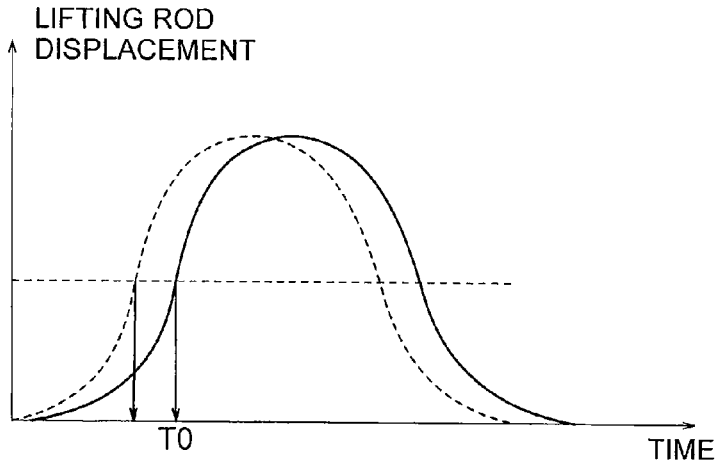
FIG. 10 is a graph that shows a case in which lifting of a lifting rod from FIG. 4 is delayed.

In such cases, because a portion of the force of inertia of the mass body that should be consumed lifting the lifting rod 21 is used in the vertical vibration of the tensioning sheave 20, as shown in FIG. 6, the lifting force on the lifting rod 21 is reduced, making the time TO until the safety device 15 is activated longer (FIG. 10). Because of that, the velocity of the car 9 may become excessively high before the safety device 15 is activated.

Consequently, when the hoisting zone is long, countermeasures that suppress vertical vibration of the tensioning sheave 20 are required. If vertical movement of the tensioning sheave 20 alone is constrained in order to suppress vertical vibration of the tensioning sheave 20, on the other hand, tension that is applied to the speed governor rope 19 due to deadweight from the tensioning sheave 20 is reduced when the speed governor rope 19 stretches due to aging, affecting rotational motion of the speed governor rope 19.

In answer to that, because the vertical vibration suppressing apparatus 22 according to Embodiment 1 allows vertical displacement of the tensioning sheave 20 during normal operation while also suppressing vertical vibration of the tensioning sheave 20 if the acceleration of the car 9 reaches the abnormal acceleration set value, rotational vibration of the speed governor rope 19 is prevented from being suppressed when an abnormal acceleration is detected without adversely affecting the rotation of the tensioning sheave 20 during normal operation, enabling the safety device 15 to be activated in a shorter amount of time.

The following design can be considered as a configuration for implementing a vertical vibration suppressing apparatus 22 of this kind. When a vertical force F acts on the tensioning sheave 20 from FIG. 2, displacement X of the tensioning sheave 20 has a relationship that is represented by the following expression:

$$dX/dt=F*1/C+dF/dt*1/K$$

where K is the spring constant of the spring 24, and C is the damping coefficient of the damper 23.

Figure 11:
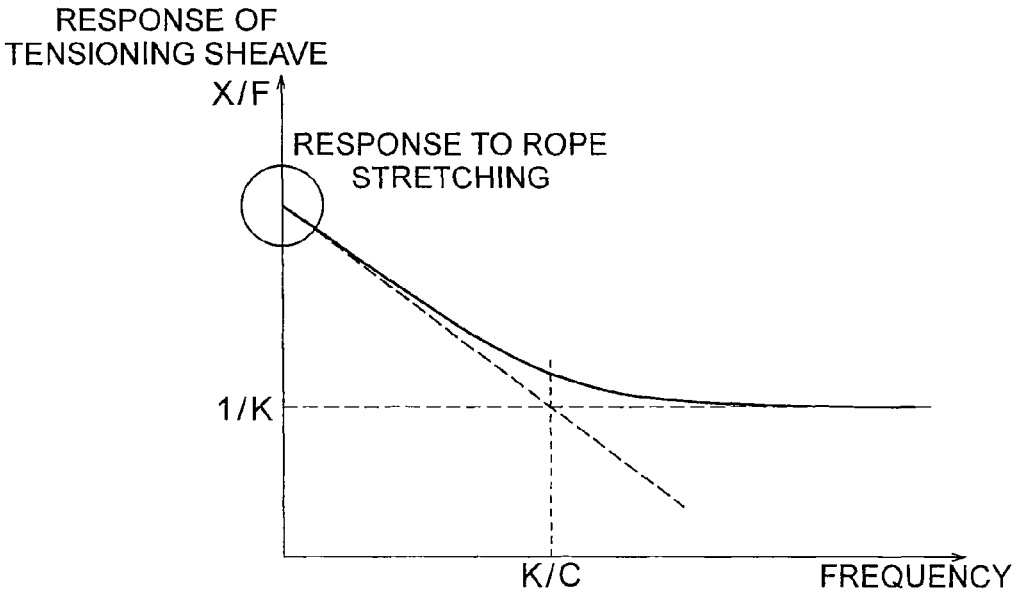
FIG. 11 is a graph that shows a relationship between frequency and response of a tensioning sheave from FIG. 2 when a force acts on the tensioning sheave.

FIG. 11 shows the result when the response of the displacement X to the force F is found from this formula. The response can be approximated by two straight lines, wherein K/C constitutes a switchover frequency. If this value is made to coincide with the primary natural frequency ω1, then:

$$\omega 1=K/C$$

Thus, at frequencies that are lower than the primary natural frequency, the tensioning sheave 20 can vibrate significantly vertically with little resistance acting on the tensioning sheave 20.

At frequencies that are higher than the primary natural frequency, on the other hand, displacement of the tensioning sheave 20 approaches:

$$X=F/K$$

Because of that, the tensioning sheave 20 displaces appropriately in response to the frequencies of the force F if the spring constant K is set to suppress the vertical displacement of the tensioning sheave 20 to the tolerance value and the damping coefficient C is set so as to be the switchover frequency at the primary natural frequency. Consequently, vertical vibration of the tensioning sheave 20 can be suppressed effectively when the safety device 15 is activated, without being affected by stretching of the speed governor rope 19.

Furthermore, by using the rotational inertia of the speed governor rope system, the safety device 15 can be activated in a short amount of time if the suspending body 8 breaks at a lower speed than an overspeed velocity set value in the speed governor 17.

Figure 12:
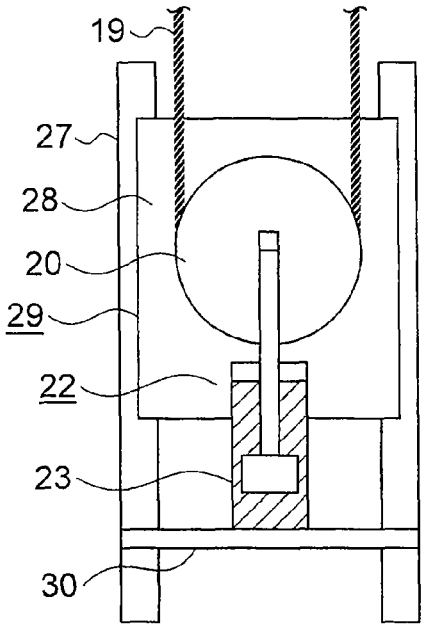
FIG. 12 is a front elevation that shows a vertical vibration suppressing apparatus from FIG. 2.
Figure 13:
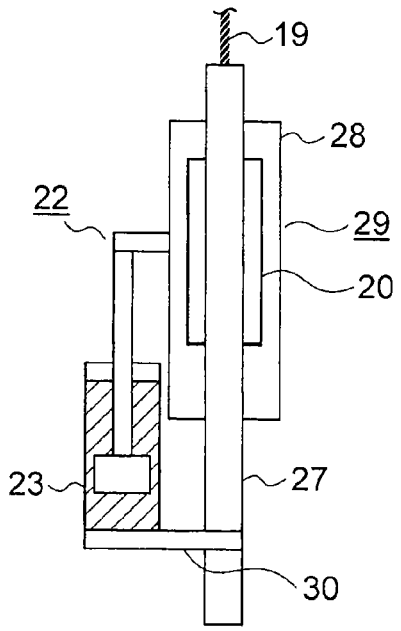
FIG. 13 is a side elevation that shows the vertical vibration suppressing apparatus from FIG. 12.

FIG. 12 is a front elevation that shows a vertical vibration suppressing apparatus 22 from FIG. 2, and FIG. 13 is a side elevation that shows the vertical vibration suppressing apparatus 22 from FIG. 12. A pair of tensioning sheave guide rails 27 are installed vertically in a bottom portion of the hoistway 1. The tensioning sheave 20 is rotatably attached to a tensioning sheave mounting member 28. The tensioning sheave mounting member 28 is movable vertically so as to be guided by the tensioning sheave guide rails 27. A tensioning sheave apparatus 29 is formed by the tensioning sheave 20 and the tensioning sheave mounting member 28. The tensioning sheave apparatus 29 is only displaceable vertically.

A base 30 is fixed in a vicinity of a lower end portion of the tensioning sheave guide rails 27. The damper 23 is installed on the base 30. A cylinder portion of the damper 23 is connected to the tensioning sheave apparatus 29 by means of the spring 24 (not depicted in FIGS. 12 and 13).

Embodiment 2

Figure 14:
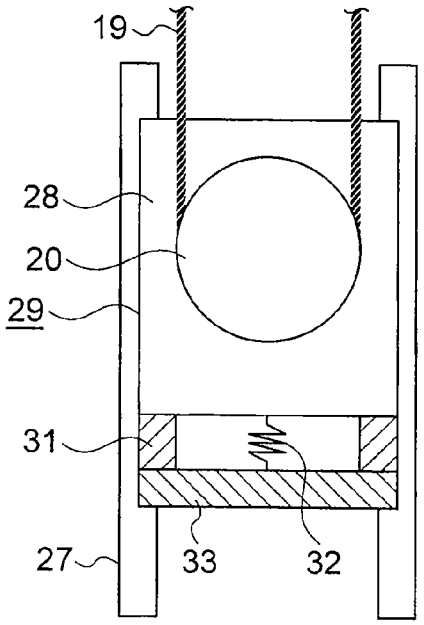
FIG. 14 is a front elevation that shows a vertical vibration suppressing apparatus of the elevator apparatus according to Embodiment 2 of the present invention.
Figure 15:
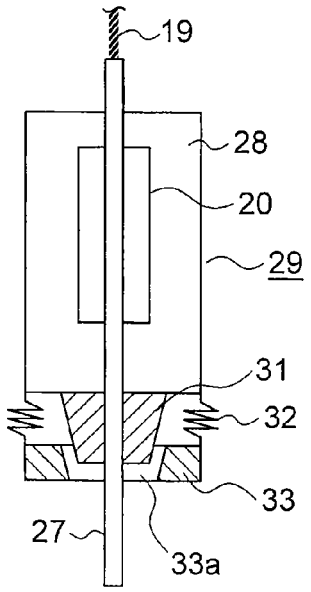
FIG. 15 is a side elevation that shows the vertical vibration suppressing apparatus from FIG. 14.

Next, FIG. 14 is a front elevation that shows a vertical vibration suppressing apparatus of the elevator apparatus according to Embodiment 2 of the present invention, and FIG. 15 is a side elevation that shows the vertical vibration suppressing apparatus from FIG. 14. Left and right pairs of wedges 31 are mounted to a lower portion of a tensioning sheave mounting member 28. The wedges 31 are disposed on opposite sides of tensioning sheave guide rails 27, and are slidable relative to the tensioning sheave guide rails 27 during normal operation.

A wedge bearing member 33 is supported on a lower portion of the tensioning sheave mounting member 28 by means of a pair of supporting springs 32. A tapered wedge insertion aperture 33*a* is disposed on the wedge bearing member 33. During normal operation, a gap is ensured between the wedges 31 and the wedge insertion aperture 33*a*.

A vertical vibration suppressing apparatus 36 according to Embodiment 2 includes the wedges 31, the supporting springs 32, and the wedge bearing member 33. The rest of the configuration is similar or identical to that of Embodiment 1.

Figure 16:
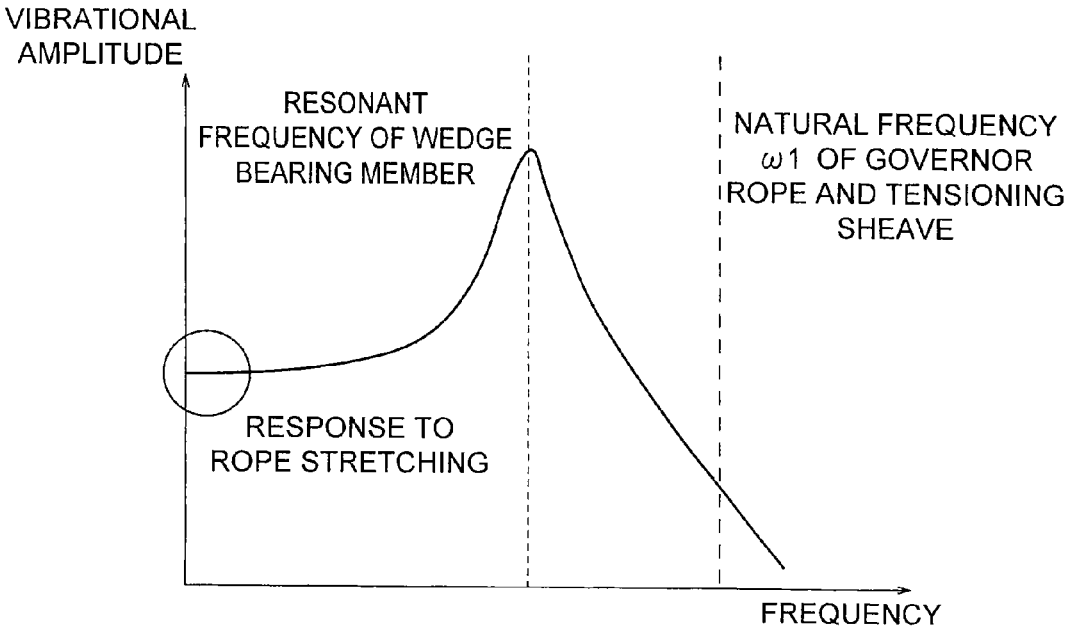
FIG. 16 is a graph that shows frequency response of a wedge bearing member from FIG. 14.

FIG. 16 is a graph that shows frequency response of the wedge bearing member 33 from FIG. 14. Resonant frequencies of the wedge bearing member 33 are set so as to be lower than the natural frequency ($\omega 1$) of the vertical vibration of the tensioning sheave 20. Because of that, in answer to stretching of the speed governor rope 19, the tensioning sheave apparatus 29, the wedges 31, the supporting springs 32, and the wedge bearing member 33 descend by an amount equal to the stretching of the speed governor rope 19, and the wedges 31 do not contact the wedge bearing member 33.

In answer to vertical vibration of the tensioning sheave 20 that arises if the suspending body 8 breaks, on the other hand, the wedges 31 contact the wedge bearing member 33 because the wedge bearing member 33 does not respond to the vibrational frequency ($\omega 1$) of the tensioning sheave 20. Here, the wedges 31 are pressed against the tensioning sheave guide rails 27 due to the wedges 31 wedging inside the wedge insertion aperture 33*a*, suppressing the vertical vibration of the tensioning sheave apparatus 29.

Consequently, according to a configuration such as that of Embodiment 2, vertical vibration of the tensioning sheave 20 can also be suppressed effectively when the safety device 15 is activated, without being affected by stretching of the speed governor rope 19.

Embodiment 3

Figure 17:
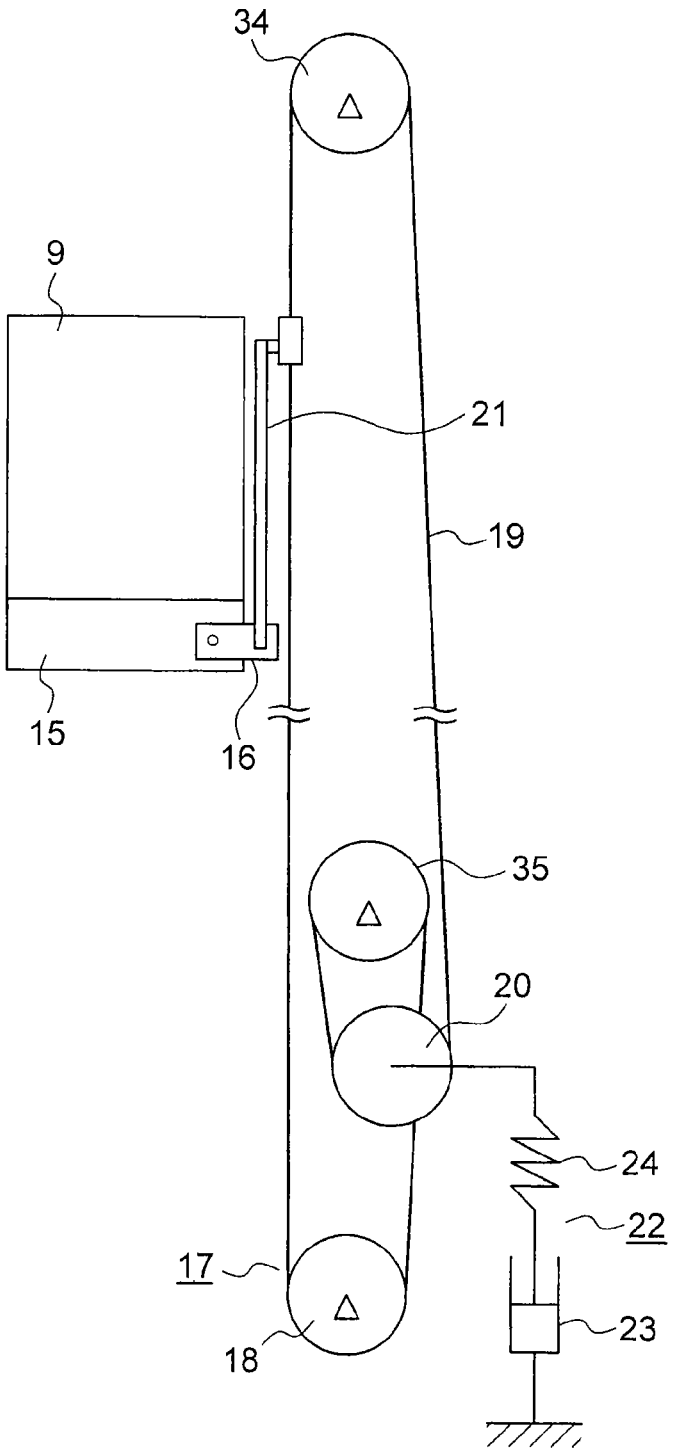
FIG. 17 is a configuration diagram that schematically shows part of an elevator apparatus according to Embodiment 3 of the present invention.

Next, FIG. 17 is a configuration diagram that schematically shows part of an elevator apparatus according to Embodiment 3 of the present invention. In Embodiment 1, a speed governor 17 is installed in an upper portion of a hoistway 1, but in Embodiment 3, a speed governor 17 is installed in a lower portion of a hoistway 1. An upper portion sheave 34 is installed in an upper portion of the hoistway 1. A deflecting sheave 35 is disposed above a speed governor sheave 18 in a lower portion of the hoistway 1. A tensioning sheave 20 is disposed below the deflecting sheave 35.

A speed governor rope 19 is directed downward from a portion that is connected to a lifting rod 21, is wound around the speed governor sheave 18 so as to be turned upward, is wound around the deflecting sheave 35 so as to be turned downward, is wound around the tensioning sheave 20 so as to be turned upward again, and is wound around the upper portion sheave 34.

The speed governor sheave 18, the upper portion sheave 34, and the deflecting sheave 35 are constrained vertically. The rest of the configuration is similar or identical to that of Embodiment 1, a vertical vibration suppressing apparatus 22 being connected to the tensioning sheave 20.

Thus, the present invention can also be applied to an elevator apparatuses of a type in which the speed governor 17 is installed in a lower portion of the hoistway 1, enabling similar effects to those in Embodiment 1 to be achieved.

Moreover, the vertical vibration suppressing apparatus according to Embodiment 2 may alternatively be applied to an elevator apparatus of a type that is shown in Embodiment 3.

In the above examples, a speed governor sheave and a speed governor rope are shown, but the rope does not need to be a speed governor rope, nor does the sheave need to be a speed governor sheave.

In addition, in FIG. 1, a one-to-one (1:1) roping elevator apparatus is shown, but the roping method is not limited thereto, and the present invention can also be applied to two-to-one (2:1) roping elevator apparatuses, for example.

Furthermore, the present invention can also be applied to machine-roomless elevators that do not have a machine room 2, or to various other types of elevator apparatus, etc.

The invention claimed is:

1. An elevator apparatus comprising:

a car that is raised and lowered inside a hoistway;

a safety device that is mounted to the car;

a plurality of sheaves that are disposed in an upper portion and a lower portion of the hoistway; and a rope that is wound onto the sheaves, the rope being connected to the safety device, and the rope being moved cyclically together with the raising and lowering of the car, a tensioning sheave that can be moved vertically in order to apply tension to the rope being included among the sheaves, and the safety device being activated if acceleration of the car reaches a preset abnormal acceleration set value, using a force that is generated by a mass body that includes the sheaves and the rope, wherein:

a vertical vibration suppressing apparatus is connected to the tensioning sheave;

the vertical vibration suppressing apparatus allows vertical vibration of the tensioning sheave during normal operation while also suppressing vertical vibration of the tensioning sheave if the acceleration of the car reaches the abnormal acceleration set value;

the vertical vibration suppressing apparatus includes a damper and a spring that are connected in series between the hoistway and the tensioning sheave;

if K is a spring constant of the spring, C is a damping coefficient of the damper and $\omega 1$ is a primary natural frequency of the vertical vibration of the tensioning sheave, then: the spring constant K is set to suppress the vertical displacement of the tensioning sheave to a tolerance value and the damping coefficient C is set to establish $\omega 1=K/C$; and the vertical vibration suppressing apparatus allows vertical vibration of the tensioning sheave at vibrational frequencies that are lower than the primary natural frequency $\omega 1$, and suppresses vertical vibration of the tensioning sheave at vibrational frequencies that are greater than or equal to the primary natural frequency $\omega 1$.

* * * * *